US007086999B2

(12) United States Patent
Jeneve et al.

(10) Patent No.: US 7,086,999 B2
(45) Date of Patent: Aug. 8, 2006

(54) BAR WITH SLIDING HANDGRIPS FOR RESISTANCE EXERCISE DEVICE

(76) Inventors: Jeff Jeneve, 4655 Gerona Way, Santa Barbara, CA (US) 93110; Jeffrey Dale Wilson, 5447 Palace Ct., Goleta, CA (US) 93111; Daniel Steven Sanchez, P.O. Box 14, Summerland, CA (US) 93067

( * ) Notice: Subject to any disclaimer, the term of this patent is extended or adjusted under 35 U.S.C. 154(b) by 253 days.

(21) Appl. No.: 10/691,733

(22) Filed: Oct. 22, 2003

(65) Prior Publication Data

US 2005/0101453 A1 May 12, 2005

(51) Int. Cl.
*A63B 21/072* (2006.01)
*A63B 21/078* (2006.01)
*A63B 21/068* (2006.01)

(52) U.S. Cl. ..... 482/106; 482/139; 482/96; 482/141; 482/904

(58) Field of Classification Search ..... 482/38–40, 482/92, 93, 95, 96, 104, 106–108, 139, 141, 482/143, 908, 49, 126; D21/679
See application file for complete search history.

(56) References Cited

U.S. PATENT DOCUMENTS 1,956,498 A * 4/1934 Duke ..... 482/126
3,118,668 A * 1/1964 Callahan ..... 482/104
3,343,837 A * 9/1967 Grzybowski ..... 482/126
4,775,149 A * 10/1988 Wilson ..... 482/126
4,943,052 A * 7/1990 Powers ..... 482/108
5,496,244 A * 3/1996 Caruthers ..... 482/108
5,620,402 A * 4/1997 Simonson ..... 482/72
5,697,873 A * 12/1997 Van Straaten ..... 482/126
6,976,942 B1 * 12/2005 Kennedy ..... 482/122
2004/0242385 A1 * 12/2004 Emick ..... 482/106
2005/0215401 A1 * 9/2005 Wilson et al. ..... 482/141

FOREIGN PATENT DOCUMENTS

CH 613119 A5 * 9/1979
RO 117506 B * 4/2002

* cited by examiner

*Primary Examiner*—Stephen R. Crow
*Assistant Examiner*—Victor K. Hwang
(74) *Attorney, Agent, or Firm*—Michael G. Petit

(57) ABSTRACT

An elongate bar having sliding handgrips concentrically mounted thereon adapted for use with a resistance-type exercise device. In a preferred embodiment, the bar has at least two, and more preferably four, axially oriented grooves in the outer surface thereof dimensioned to accommodate handgrip linking means therewithin. The handgrips, which are constrained to move only in an axial direction, are interconnected by linking means such as belts, in such a manner that the handgrips remain equidistant from the center of the bar throughout their axial range of motion. The interconnecting belts or cables are disposed to travel within the elongate grooves on the bar to provide the bar with a low profile. In the preferred embodiment, the linking means are belts that are supported by pulleys housed within recesses in the bar and rotatably attached thereto. The bar further includes resistive force attachment means operable for attaching weights, springs, cable(s), elastic bands or the like thereto to provide a resistive force. In a further embodiment, the bar includes floor supporting means and can be used for performing pushups. In yet a further embodiment, the bar includes wall attachment means and can be employed for performing pull-ups.

8 Claims, 7 Drawing Sheets

BAR WITH SLIDING HANDGRIPS FOR RESISTANCE EXERCISE DEVICE

BACKGROUND OF THE INVENTION

1. Field of the Invention

The present invention relates to a resistance exercise device and, more particularly, to a bar having a pair of handgrips slidably mounted thereon, the bar being adapted to be attached to a resistive force such as weights.

2. Prior Art

Resistance exercise devices are well represented in the art. Perhaps the most common such device is the barbell in which weights are removably attached to opposing ends of an elongate bar. An exercisor grips the bar with both hands and moves the bar and weights through a range of motion against the force of gravity. In most such barbell devices, the handgrips are a knurled or textured portion on the outer surface of the bar and necessarily remain stationary with respect to the bar throughout the movement (repetition). Brasher, in U.S. Pat. No. 4,585,229, discloses an exercising apparatus including a bar having a pair of rings slidably connected thereto. Handgrips for gripping by the hand of the user are positioned within, and rotatably connected to, each of the rings. A cable connects the two rings to one another for maintaining each ring at an equal distance from the end of the bar. The assembly permits the handgrips to both rotate and move laterally during a repetition. A disadvantage of the Brasher device is that the oval bar employed to mount the cable-supporting pulleys upon has a high profile and does not have the familiar appearance and feel of a conventional (stationary handgrips) barbell wherein the bar is not oval but substantially cylindrical.

Dibrowski, in U.S. Pat. No. 4,978,122 discloses a barbell wherein the handgrips are concentrically and slidably mounted on a bar and are free to rotate and slide axially. The axial motion of the handgrips is constrained by laterally disposed springs concentrically mounted on the bar, and by medially disposed stops. The springs are connected to the lateral ends of the handgrips and to the weight bar. The springs are passive centering devices that serve to generally maintain the handgrips equidistant from the center of the bar. In the event the bar tilts during a lift, the lower spring will extend and the higher spring will compress. There is no constraining interconnection of the handgrips to maintain their axial position on the bar equidistant from the center of the bar. Accordingly, due to the compressibility and extensibility of the springs, the Dibrowski device may become unbalanced when the handgrips are not equidistant from the center of gravity of the weighted bar as, for example, when the bar is tilted.

Another barbell-type resistance exercise device wherein the bar includes slidably mounted handgrips is disclosed by Troutman in U.S. Pat. No. 5,152,731. While the Troutman device permits the position of the handgrips to shift in an axial direction during a repetition, as with Dibowski, the handgrips are not interconnected to keep the handgrips equidistant from the center of gravity of the bar. Each grip includes a number of bearings that allow the grip to slide along the bar without resistance. The grips and bar include complementary anti-rotation apparatus that prevents the grips from rotating about the longitudinal axis of the bar. A number of adjustable stop members may also be placed on the bar to limit the axial travel of the grips. It is common for one arm of an exerciser to be stronger (or more fatigued) than the other. As a result, when an exerciser lifts the bar, one hand will lag relative to the other hand during the lift, tilting the bar from the horizontal. While a slight tilt is normally not a problem, with the Troutman device the bar will slide sideways through the handgrips in the direction of the lower hand. This, in turn, shifts more weight over the more fatigued or weaker arm, causing it to drop further and with weight shifted off of the stronger arm, it will rise faster causing a rapidly increasing tilt in the bar. The result is that the Troutman bar can quickly slide to one side causing the lower arm to collapse, cause muscle strain, or even cause the exerciser to fall off of the bench.

Surprisingly, a bar for a resistance-type exercise device combining the most desirable features of prior art exercise bars to overcome the limitations of each has not been suggested or disclosed in the art. There remains a need for a bar having non-rotatable, slidably mounted handgrips for use with an exercise device wherein the bar has a low profile and remains balanced throughout the range of motion of an exercisor.

SUMMARY

It is an object of the present invention to provide a resistance exercise device and a bar for use with the resistance exercise device. The bar comprises slidably mounted handgrips that are mounted to move only in an axial direction parallel to the long axis of the bar. In a preferred embodiment, the resistance exercise device of the present invention comprises: (a) an elongate bar having first and second ends and a midpoint therebetween; (b) weight attachment means affixed to the bar adjacent to the first and second ends and disposed equidistant from the midpoint of the bar, the weight attachment means being operable for removably attaching weights or another resistive force to the bar; (c) first and second handgrips slidably mounted on the bar and disposed equidistant from the midpoint of the bar wherein the handgrips are preferably nonrotatable and can be moved on the bar in an axial direction (i.e., parallel to a longitudinal axis of the bar); and (d) handgrip coupling means connecting the first handgrip to the second handgrip, the coupling means being operable for maintaining the first and second handgrips equidistant from the midpoint of the bar when the first and second handgrips are moved in an axial direction. Each of the handgrips may also include adjustable braking means operable for either dampening or preventing the sliding action of the handgrips with respect to the bar.

In a further embodiment, the bar includes floor supporting means and can be used for performing pushups. In yet a further embodiment, the bar includes wall attachment means and can be employed for performing pull-ups. The pull up version can be floor mounted. The features of the invention believed to be novel are set forth with particularity in the appended claims. However the invention itself, both as to organization and method of operation, together with further objects and advantages thereof may be best understood by reference to the following description taken in conjunction with the accompanying drawings.

BRIEF DESCRIPTION OF THE DRAWINGS

FIG. 2(*b*) is an elevational view of a bar for performing a resistance exercise in accordance with the present invention wherein the handgrips are slid away from one another in an axial direction and are disposed laterally on the bar.

DESCRIPTION OF THE PREFERRED EMBODIMENTS

Figure 1:
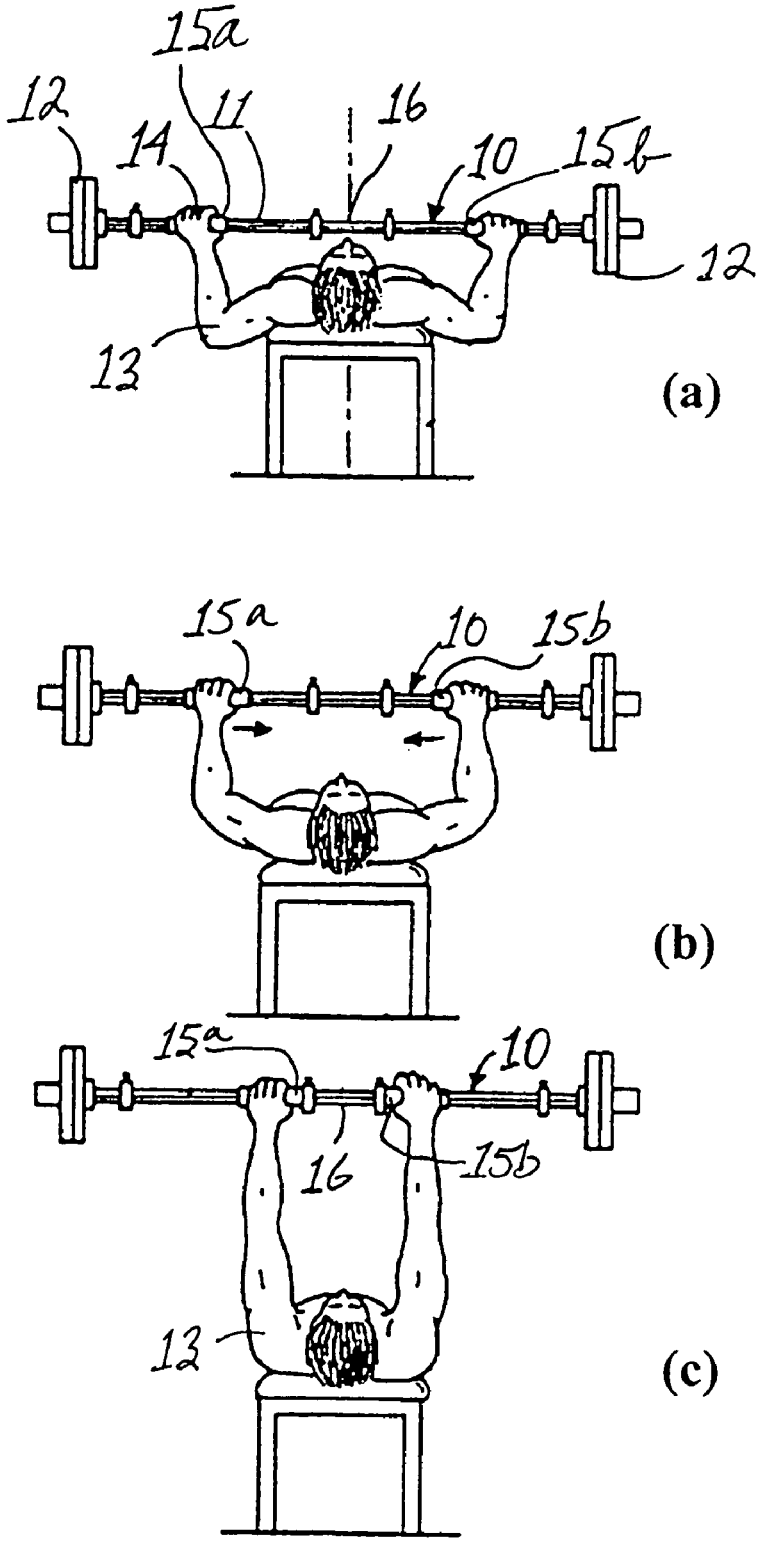
FIGS. 1(*a*)–(*c*) are a sequence of drawings illustrating various instantaneous (i.e., "snap-shot") hand positions that may occur during a lifting repetition using an exercise device in accordance with the present invention.

The present invention provides an exercise apparatus for performing two-handed exercises includes a bar to which a resistive force is applied and a pair of handgrip assemblies concentrically and slidably attached to the bar which the user grips in order to move the bar during an exercise. The resistive force may be simply the weight of the bar or it may comprise weights connected to the bar. Alternatively, another piece of equipment capable of providing a resistive force can be connected to the bar by resistive force attachment means such as, for example, by a cable or two "U"-bolts. Each handgrip is slidably connected to the bar, the sliding paths being generally parallel to the long axis of the bar, generally in line with each other, and disposed symmetrically with respect to a center plane perpendicular to the long axis of the bar and intersecting the bar at the center of gravity thereof. (The terms "generally parallel" and "generally in line" are meant to include variations of up to approximately 30 degrees and offsets of up to approximately 12 inches.) The handgrips are linked together by handgrip linking means to maintain each handgrip generally at an equal distance from the center of gravity of the bar. Thus the handgrips are constrained to move only in opposition to one another in an axial direction (i.e., toward and away from the center plane). The linking means may be a pair of belts guided over pulleys mounted at each end of the bar, with one end of the first belt connected to the lateral end of a first handgrip and the opposing end of the first belt connected to the medial end of the second handgrip. One end of the second belt is attached to the medial end of the first handgrip and the opposing end of the second belt attached to the lateral end of the second handgrip. Alternatively, the linking means for interconnecting the handgrips may incorporate a pinion gear rotatably mounted on the bar and engaged to gear racks connected separately to each handgrip. In yet a further embodiment, the linking means may include two oppositely directed helical threads that rotate together along their common axis and separately engage each handgrip, the handgrips being restrained from rotating with respect to each other. A number of fixed or adjustable stop members may also be placed on the bar to limit the travel of the handgrips. The handgrips may further include braking and/or locking means operable for varying the resistance of the handgrips to sliding in an axial direction (i.e., in a direction parallel to the axis of the handgrip), or locking the handgrips in a preferred position with respect to the center plane of the bar.

The bar, described above, may be adapted for the performance of a variety of other types of exercises wherein the exercisor's weight provides the resistive force. In a further floor-supported embodiment, the bar includes, or is placed upon, floor supporting means and can be used for performing pushups. In yet a further wall-supported embodiment, the bar includes, or is adapted to be attached to, wall attachment means and can be employed for performing pull-ups. The various embodiments of the bar, notwithstanding the nature of the resistive force, all include slidably mounted handgrips that are interlinked so as to maintain the handgrips equidistant from a center plane of the bar as will be discussed below. The pull up version can also be floor mounted.

Turning now to FIG. 1, a preferred embodiment of an exercise device in accordance with the present invention is indicated at numeral 10. The device 10 comprises an elongate bar 11 having weights 12 attached thereto. An exercisor 13 places his/her hands 14 on handgrips 15*a* and 15*b* that are slidably attached to the bar 11. In FIG. 1(*a*) the exercisor is shown beginning a lift with his/her hands positioned near the lateral ends of the bar adjacent the weights. As the lift progresses, as shown in FIG. 1(*b*), the hands (and handgrips 15*a* and 15*b*) move in a medial direction as indicated by the arrows until at the apex of the lift (FIG. 1(*c*)), the hands and handgrips are disposed adjacent the center 16 of the bar 11. The ability of the hands to move inwardly during a lift enables more work to be done (the weights are lifted higher) than if they remain laterally disposed adjacent the weights throughout the lift. In addition, the lift involves the use of more (and different) muscles than with stationary handgrips. As the device 10 is lowered to its initial position (FIG. 1(*a*)), the hands and handgrips may be slid outwardly to begin another repetition of lifting. The bar of the present invention, when used with an exercise device as disclosed hereinbelow, provides several important advantages over prior are bars. The bar enables the isolation of desired muscles and increases the effective range of exercise motion for exercises such as bench press, incline press, military press, triceps extensions, bent over row, etc. In addition, the bar reduces joint stress and pain. The bar also enables self-spotting by a user (by sliding handles out against stops). Further, the present bar makes it easier to handle and adjust weight than with dumbbells. The present bar makes new exercises possible.

Figure 2A:
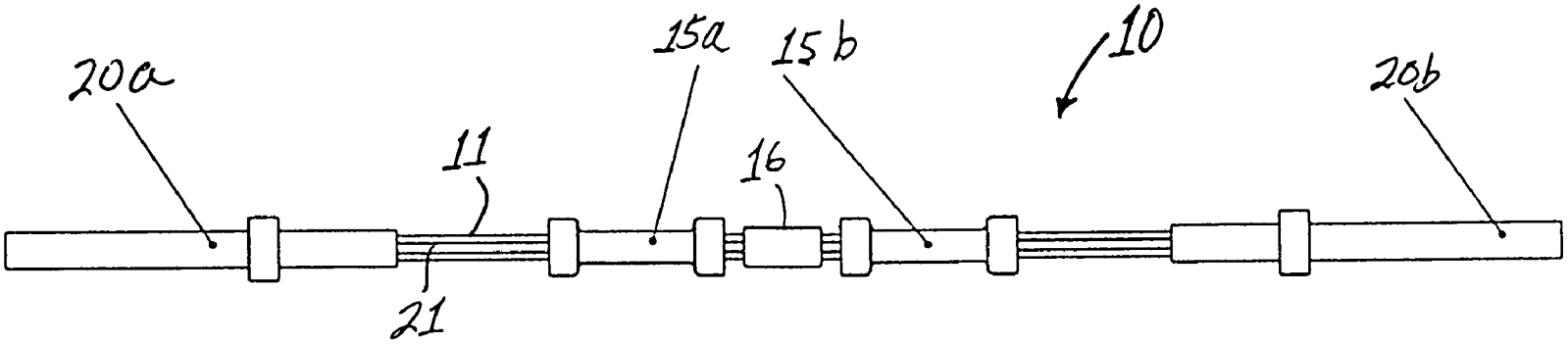
FIG. 2(*a*) is an elevational view of a bar for performing a resistance exercise in accordance with the present invention wherein the handgrips are slid toward one another and are disposed medially on the bar.
Figure 2B:
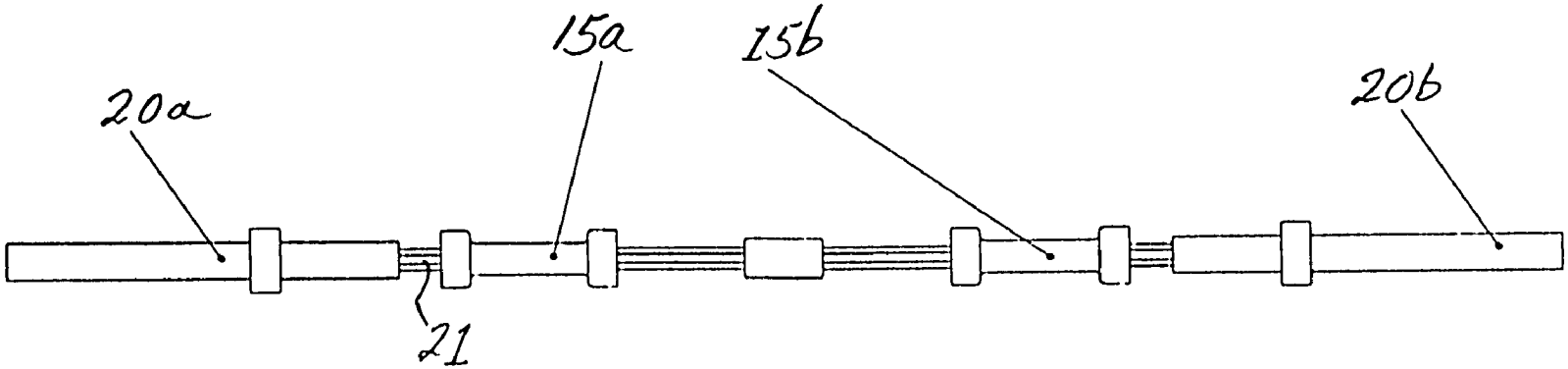

With reference to FIGS. 2(*a*) and 2(*b*), the device 10 is shown in elevational view with the first and second handgrips 15*a* and 15*b* slid inwardly and disposed adjacent the center 16 of the bar 11 (FIG. 2(*a*)) and extended laterally adjacent the weight attachment means 20*a* and 20*b* as indicated in FIG. 2(*b*). A groove 21 is visible in FIGS. 2(*a*) and 2(*b*) that serves to house a handgrip linking means (i.e., handgrip interconnecting means), most preferably a pair of belts, as will be discussed below.

Figure 4:
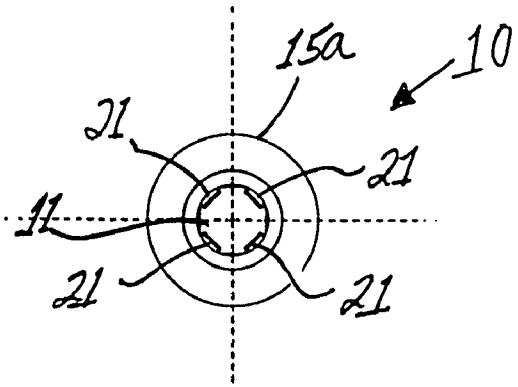
FIG. 4 is a cross-sectional view of the bar and handgrip of FIG. 3 taken along section line 4—4 illustrating the elongate grooves in the outer surface of the bar underlying the handgrip(s).
Figure 3:
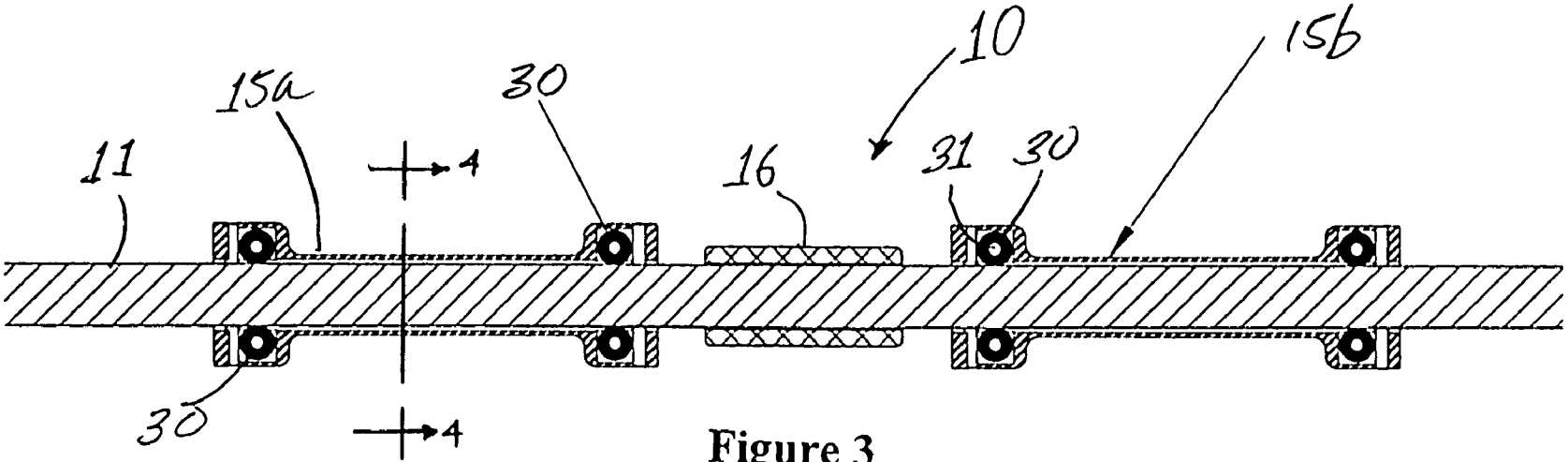
FIG. 3 is a cross-sectional front view of a central portion of a bar for a resistance exercise device in accordance with the present invention showing the disposition of the handgrip bearings.

As used herein, the term "low profile," when used in the context of a characteristic of the bar 11, means that the diameter of the bar 11 is substantially the same as the diameter of a conventional cylindrical bar that is commonly employed in barbells to support a weight and provide handgrip means for lifting the weight. The low profile bar of the present invention is not bifurcated along any portion of the length thereof. FIG. 3 is a longitudinal cross-sectional view of a central portion of the device 11 illustrating the plurality of roller bearings 30 housed within the handgrips 15*a* and 15*b*. The roller bearings 30 are mounted on axles 31 affixed to the respective handgrips and are employed to facilitate a smooth sliding action of the handgrips over the bar. FIG. 4 is a cross-sectional view of the bar 11 and handgrip 15*a* of FIG. 3 taken along section line 4—4 illustrating the elongate grooves 21 in the outer surface of the bar 11 underlying the first and second handgrip(s) 15*a* and 15*b* throughout the range of axial motion of the handgrips.

Figures 5, 6:
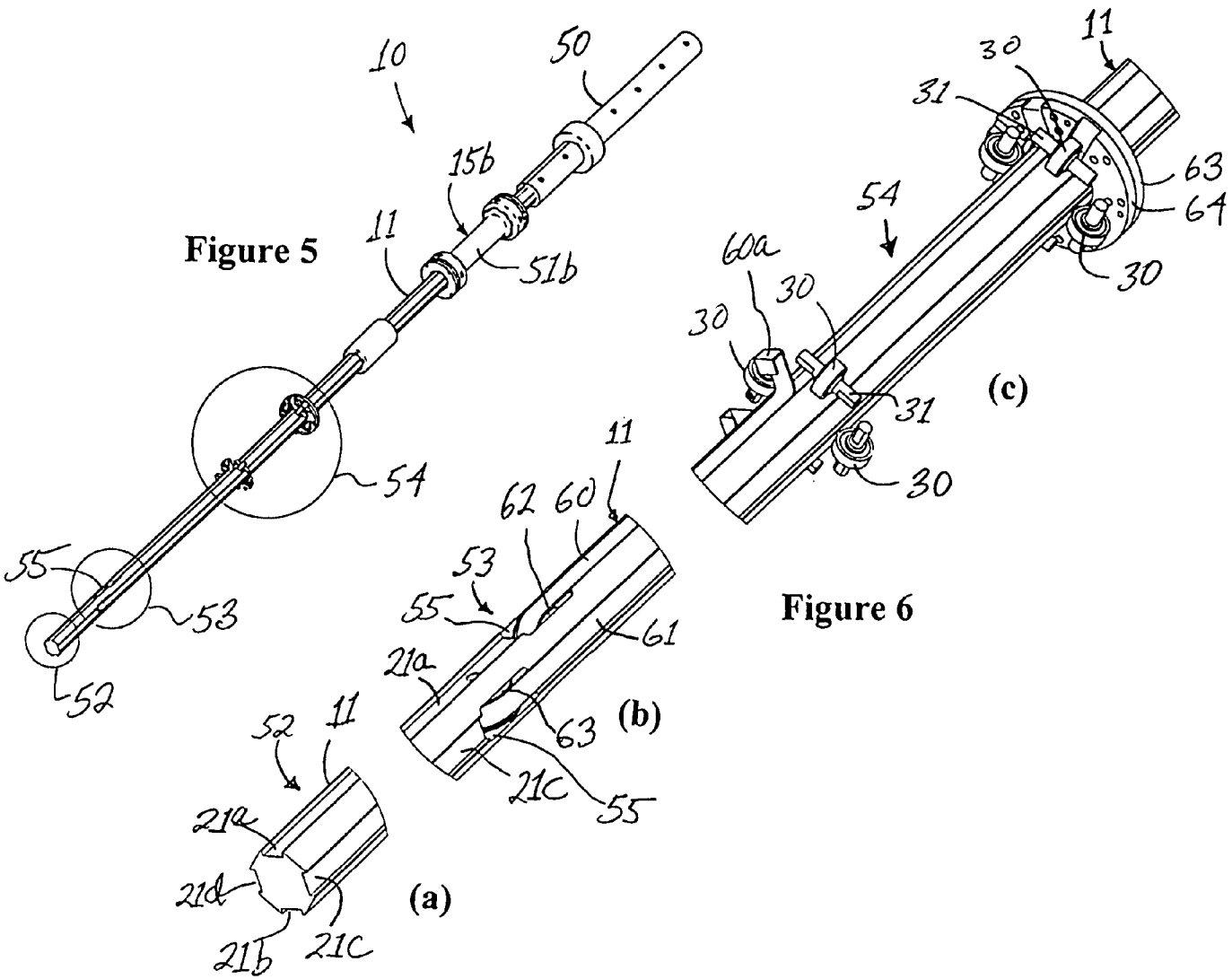
FIG. 5 is a perspective view of a preferred embodiment of a bar for an exercise device in accordance with the present invention with the resistive force attachment means and handgrip removed to expose detail.
FIG. 6(*a*)–(*c*) are exploded perspective views of respective exposed portions of the bar illustrated in FIG. 5.

FIG. 5 is a perspective view of a preferred embodiment of a bar for an exercise device in accordance with the present invention with the resistive force attachment means 50 and a central gripping portion 511*a* (not present in FIGS. 5 and 6) of handgrip 15*a* removed to expose detail. One end of the bar 11 comprising the device 10 is indicated at 52 in FIG. 5 and in greater detail in FIG. 6(*a*). A pulley assembly 53, shown in greater detail in FIG. 6(*b*), is disposed within a recess 55 in the bar 11 and supports belts 60 and 61 attached to the handgrips as will be discussed below. A portion 54 of handgrip 15*a*, illustrated in greater detail in FIG. 6(*c*), remains attached to the bar to illustrate the means employed to attach handgrip 15*a* to the belts 60 and 61 and the bearings 30 employed to assist the handgrips to slide along the bar. In FIGS. 5–8, the handgrip interconnecting means illustrated therein comprise a plurality of belts 60 and 61 that travel over sheaves or pulleys 62–65. Pulleys 62 and 64 are oriented to rotate about an axis that is orthogonal to the axis of rotation of pulleys 63 and 65. The purpose of the duplicate belt interlinking arrangement is to provide redundancy in order to prevent the handgrips from being disconnected in the event that one of the belts 61 break.

With reference now to FIG. 6(*a*), the end of the bar 11 is shown in enlarged perspective view having four elongate grooves 21*a*–*d* in the cylindrical outer surface of the bar 11. Grooves 21*a* and 21*b* serve to house and guide belt 60 (FIG. 6(*b*)), while grooves 21*c* and 21*d* house and guide the redundant belt 61. In FIG. 6(*b*), the pulleys 62 and 63 are shown to be rotatably mounted in recesses 55 within the bar 11. Pulley 62 supports belt 60 while pulley 63 supports the redundant belt 61. A pair of return pulleys 64 and 65 (FIG. 8(*d*)) mounted within recesses 55 in the opposing end of the bar 11 also support belt 60 and redundant belt 61 respectively. For simplicity, only the primary belt 60 will be discussed. The interconnection and operation of the redundant belt 61 and the handgrips is the same as the primary belt 60.

Figure 7:
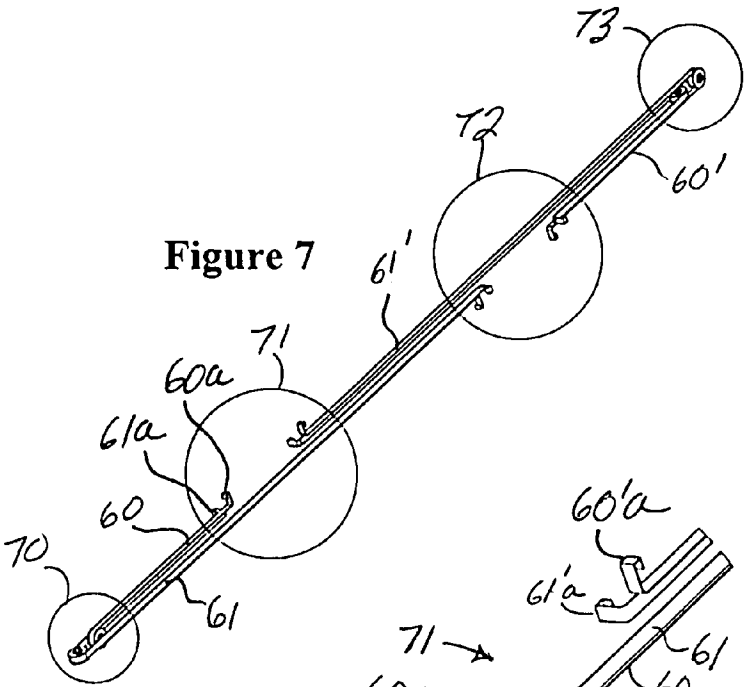
FIG. 7 is a perspective view showing the arrangement of the handgrip linking belts and belt support pulleys employed in the bar of the present invention to maintain the handgrips equidistant from the center of the bar throughout the range of axial movement of the handgrips over the bar. In the preferred embodiment of the handgrip interlinking assembly shown, two sets of belts are provided, disposed in orthogonal planes, to provide redundancy in the event one belt breaks.
Figure 8:
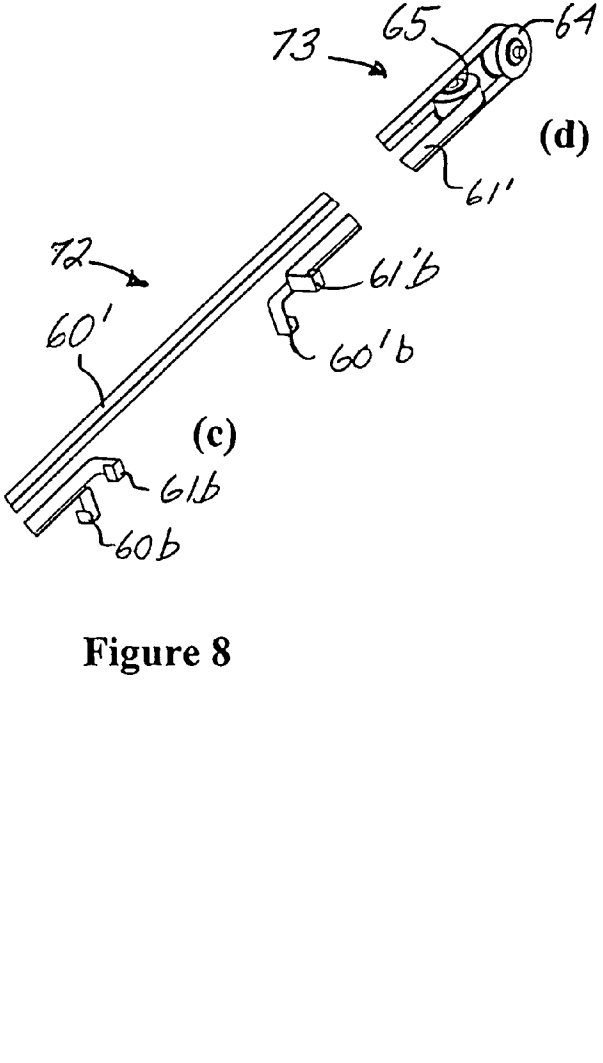
FIG. 8(*a*)–(*d*) are respective enlarged perspective views of the portions of the handgrip linking belts and support pulleys indicated in FIG. 7.
Figure 9:
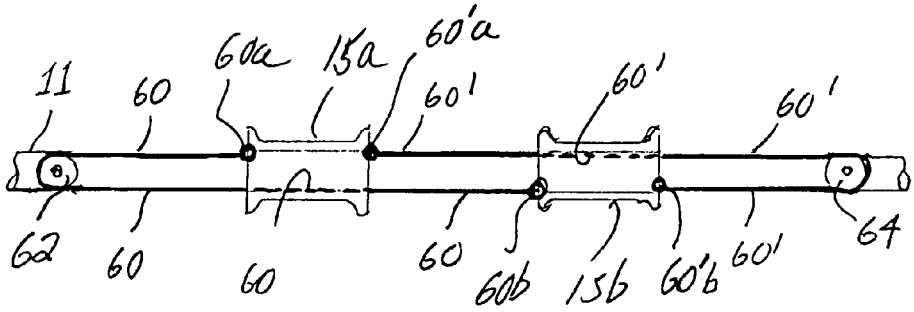
FIG. 9 is an elevational view of a preferred embodiment of a bar showing the interconnection of the handgrips by a single pair of belts housed preferably within grooves in the outer surface of the bar to provide the bar with a low profile.

Turning now to FIG. 6(*c*), a portion of handgrip 15*a* is illustrated in perspective view. The handgrips 15*a* and 15*b* have a pair of lateral grip mounting plates: an outer plate 63 and an inner plate 64 to which the central gripping portion (not shown) is bolted. A pair of medial grip mounting plates (also not shown), are mirror images of the lateral gripping plates and have been removed in FIG. 6(*c*) to illustrate the manner in which the recurved end 60*a* of the belt 60 is adapted to be attached to the handgrips 15*a* and 15*b* via compression between the grip mounting plates. With alternate reference to FIGS. 6–8, primary belt 60 is segmented into first and second primary belts 60 and 60' of equal length as shown in FIGS. 7 and 8(*a*)–(*d*). A first end 60*a* of the first primary belt segment 60 is compressed between the lateral gripping plates (not shown in FIG. 6(*c*)) which are then bolted to one another. The opposing end 60*b* (FIG. 8(*c*)) of the first primary belt segment 60 is guided around pulley 62 and emerges from the recess 55 in the bar to lie within groove 21*b* where it extends along groove 21*b* to handgrip 15*b* where it is attached, again by compression, between the medial grip mounting plates of handgrip 15*b*. A first end 60'*a* of primary belt segment 60', also recurved as shown, is trapped between inner and outer grip mounting plates 63 and 64 on the medial end of handgrip 15*a* and extends along the groove 21*a*, aroung pulley 64 and along groove 21*b* where the opposing end 60'*b* of the second segment 60' is attached between the lateral grip mounting plates 63 and 64 of handgrip 15*b*, thereby completing the interconnection of the handgrips. The interlinking belt assembly provides means for maintaining an equal distance between the handgrips and the center of gravity of the bar when sliding the handgrips in an axial direction. FIG. 9 is an elevational view of a preferred embodiment of a bar showing the interconnection of the handgrips 15*a* and 15*b* by a pair of belts 60 and 60' housed preferably within grooves in the outer surface of the bar to provide the bar with a low profile. Only belts 60 and 60' are shown in FIG. 9 for simplicity. It is understood that the bar preferably also includes a redundant pair of belts 61 and 61' (not shown in FIG. 9) as a safety feature in the event the primary belt comprised of belt segments 60 and 60' breaks.

Returning now to FIG. 6(*c*), it is desirable to provide the handgrips with bearings to facilitate sliding motion of the handgrips. Each handgrip 15*a* and 15*b* is preferably provided with eight roller bearings 30 as illustrated. The bearings 30 are disposed on the lateral and medial ends of the gripping portion of each handgrip adjacent to the handgrip mounting plates. Four holes are drilled at right angles to each adjacent hole in the gripping portion near each end of the handgrip to house the axles 31 about which the respective bearings 30 rotate.

Figure 10:
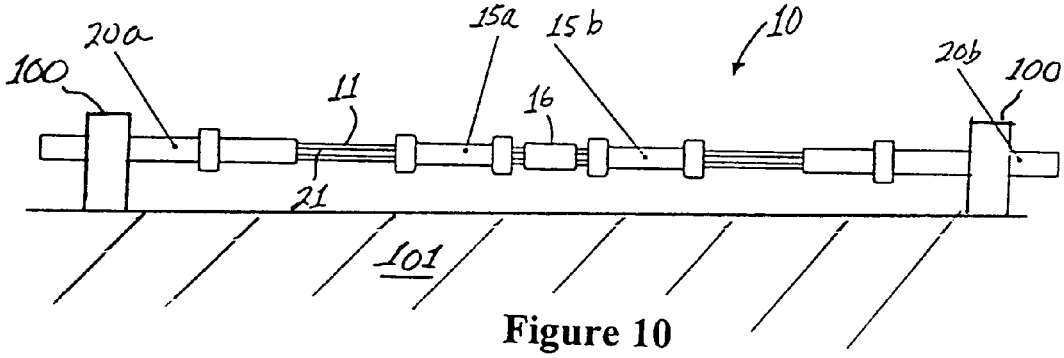
FIG. 10 is an elevational view of a bar in accordance with the present invention supported on a floor by floor-supporting means.

FIG. 10 is an elevational view of a bar 10 in accordance with the present invention supported on a floor by floor-supporting means 100. The bar 10, when placed on floor-supporting means 100 for stabilization upon a floor 101, can be used for performing pushups. The supports 100 serve to elevate the bar 10 above the floor 101 and enable the handgrips 15*a* and 15*b* to slide while the bar is thus supported. The exercisor lies on the floor in a prone position with his/her hands placed on the handgrips, and repetitively elevates his/her upper body by pressing downwardly on the handgrips. The ability of the handgrips to slide in an axial direction while performing the exersise renders a pushup more difficult to perform, and exercises more muscle groups than is possible with stationary handgrips. Similarly, the bar 10 can be supported on a wall or within a doorway or vertical support structures for performing pull-ups.

Figure 11A:
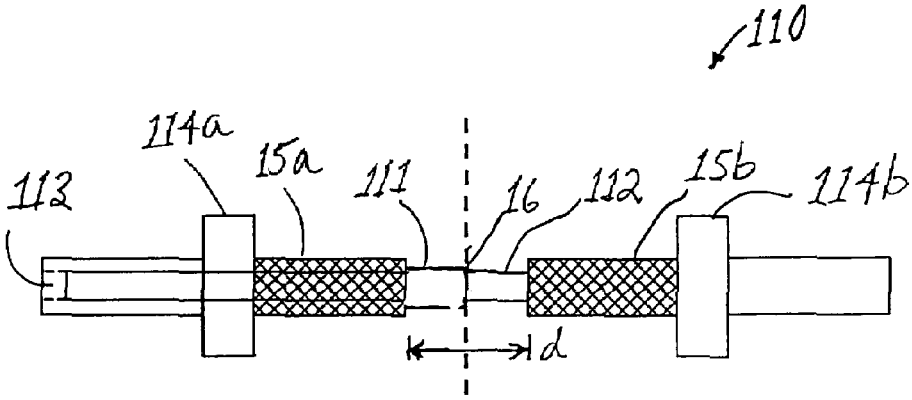
FIG. 11*a* is an elevational view of a cylindrical member comprised of two telescopically mounted members, each member having a handgrip attached thereto and disposed equidistant from a center plane.
Figure 11B:
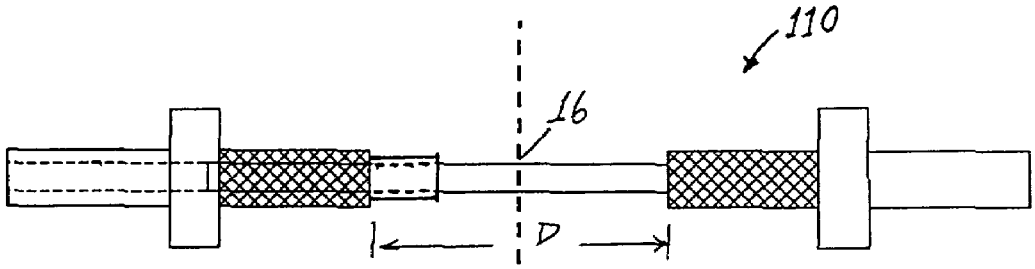
FIG. 11*b* shows the cylindrical member of FIG. 1*a* with the handgrips moved laterally outwardly while remaining equidistant from the center plane throughout the range of motion of the handgrips.

The general principles of the present invention are illustrated in an embodiment of the exercise device shown in FIGS. 11*a* and 11*b*. The device 110 is comprised essentially of an outer tube 111 and an inner tube 112 telescopically mounted to one another. The outer tube 111 has an axial bore 113 that accommodates one end of the inner tube 112 therewithin. The linear density of the inner and outer tubes is preferably equal. The outer tube 111 has a first handgrip 15*a* affixed to an outer surface thereof and the inner tube 112 has a second handgrip affixed to an outer surface. The outer and inner tubes may further have weights 114*a* and 114*b* attached thereto. In FIG. 11*a*, the handgrips 15*a* and 15*b* are separated from one another by a distance d and disposed equidistant (i.e., a distance d/2) with respect to a center plane 16 which center plane 16 intersects the device at the center of gravity thereof. FIG. 111*b* shows the device 110 with the handgrips separated from one another by a distance D wherein D is greater than d. The construction of the device 110 is such that when the handgrips 15*a* and 15*b* are moved in an axial direction, each of the handgrips remain equidistant (i.e., a distance D/2) from the center plane 16 throughout their range of motion.

While a particular embodiment of the present invention employing interconnecting belts as handgrip centering means has been illustrated and described, it would be obvious to those skilled in the art that various other changes and modifications can be made without departing from the spirit and scope of the invention. For example, damping means can be employed to provide adjustable resistance to the axial motion of the handgrips. The handgrips may also be adapted to include manually adjustable stops operable for locking the handgrips in a preferred position on the bar. Further, a tubular sleeve can be rotatably mounted over the handgripping portion 51*b* and 51*b* of the handgrips 15*a* and 15*b* to enable the bar 10 to rotate during an exercise. Yet further, a tubular sleeve can be rotatable mounted over the weight attachment means 20*a* and 20*b* to enable the weights to rotate relative to the bar. In yet a further embodiment, weights may be attached directly to the handgrips. It is therefore intended to cover in the appended claims all such changes and modifications that are within the scope of this invention.

What is claimed is:

1. A resistance exercise device comprising: (a) an elongate, free-standing, nonbifurcated, substantially cylindrical bar having first and second ends and a center plane therebetween, said center plane intersecting said bar at a center of gravity thereof; (b) first and second handgrips slidably mounted on said bar and disposed equidistant from said center plane wherein said handgrips have a longitudinal axis and can be slidingly moved on said bar in a direction parallel to said longitudinal axis of said handgrips; and (c) coupling means housed in recesses in said bar, said coupling means connecting said first handgrip to said second handgrip, said coupling means being operable for maintaining said first and second handgrips equidistant from said center plane when said first and second handgrips are moved in a direction parallel to said longitudinal axis of said handgrips.

2. The resistance exercise device of claim 1 further comprising resistive force attachment means affixed to said first and second ends of said free-standing bar, said resistive force attachment means being operable for removably attaching weights to said free-standing bar.

3. The resistance exercise device of claim 2 wherein said resistive force attachment means are disposed equidistant from said center plane of said free-standing bar.

4. The resistance exercise device of claim 1 further comprising tubular sleeves rotatably and concentrically mounted on said first and second handgrips.

5. The resistance exercise device of claim 1 wherein said free-standing bar has a weight and wherein when an exercisor grasps said first and second handgrips and exerts a force to elevate said free-standing bar, said weight of said free-standing bar provides a resistive force in opposition to said force exerted to elevate said free-standing bar.

6. A resistance exercise device comprising:

(a) an elongate, nonbifurcated, substantially cylindrical free-standing bar having a weight, a length, a plurality of grooves in an outer surface thereof and a longitudinal axis coextensive with said length defining an axial direction, said cylindrical free-standing bar having first and second ends and a center plane therebetween wherein said center plane intersects said cylindrical free-standing bar at a center of gravity thereof;

(b) first and second handgrips disposed on said cylindrical free-standing bar equidistant from said center plane, said first and second handgrips adapted to provide means enabling an exercisor to grasp said cylindrical free-standing bar; and (c) coupling means comprising belts interconnecting said first and second handgrips, said belts disposed within said grooves in said free-standing bar, said coupling means being operable for enabling said first and second handgrips to be moved relative to each other in said axial direction while maintaining said first and second handgrips equidistant from said center plane.

7. The resistance exercise device of claim 6 wherein when an exercisor grasps said first and second handgrips and exerts a force to elevate said cylindrical free-standing bar, said weight provides a resistive force in opposition to said force exerted to elevate said cylindrical free-standing bar.

8. The resistance exercise device of claim 6 wherein said cylindrical free-standing bar further comprises weight attachment means adjacent to said first and second ends and equidistant from said center plane, said weight attachment means being operable for removably attaching weights to said cylindrical free-standing bar.

* * * * *